US006339379B1

(12) United States Patent
Argus et al.

(10) Patent No.: US 6,339,379 B1
(45) Date of Patent: Jan. 15, 2002

(54) CARBON MONOXIDE DETECTOR

(76) Inventors: Michael A. Argus; Joyce Argus, both of 3311 Wildcat Rd., Buena Vista, PA (US) 15018

( * ) Notice: Subject to any disclaimer, the term of this patent is extended or adjusted under 35 U.S.C. 154(b) by 0 days.

(21) Appl. No.: 09/586,357

(22) Filed: Jun. 2, 2000

(51) Int. Cl.[7] ..... G08B 17/00

(52) U.S. Cl. ..... 340/632; 340/539; 431/16; 431/22

(58) Field of Search ..... 340/632, 539; 431/16, 22

(56) References Cited

U.S. PATENT DOCUMENTS 4,665,385 A * 5/1987 Henderson ..... 340/539
5,239,980 A 8/1993 Hilt et al.
D350,300 S 9/1994 Browning et al.
5,379,026 A 1/1995 Whittle
5,576,739 A 11/1996 Murphy
5,608,384 A 3/1997 Tikijian
5,786,767 A * 7/1998 Severino ..... 340/632
5,793,296 A * 8/1998 Lewkowicz ..... 340/632
5,838,243 A * 11/1998 Gallo ..... 340/632
5,896,089 A 4/1999 Bowles
5,966,076 A * 10/1999 Cantrell ..... 340/605
6,045,352 A * 4/2000 Nicholson ..... 431/22

* cited by examiner

*Primary Examiner*—Daniel J. Wu

(57) ABSTRACT

A carbon monoxide detector for detecting the level of carbon monoxide in a furnace supply duct. The carbon monoxide detector includes a carbon monoxide detector that has a housing. The housing is coupled to an exterior surface of a furnace supply duct of a furnace. The carbon monoxide detector also has a probe assembly that extends outward from the housing into the furnace supply duct for detecting a level of carbon monoxide in the furnace supply duct. The carbon monoxide detector further has a control unit. The control unit is operationally coupled with a limiting switch of the furnace. The control unit provides a signal to the limiting switch upon detection of a carbon monoxide level above a pre-determined level whereby the limiting switch is activated to shut off the furnace.

7 Claims, 3 Drawing Sheets

CARBON MONOXIDE DETECTOR

BACKGROUND OF THE INVENTION

1. Field of the Invention

The present invention relates to carbon monoxide detectors and more particularly pertains to a new carbon monoxide detector for detecting the level of carbon monoxide in a furnace supply duct.

2. Description of the Prior Art

The use of carbon monoxide detectors is known in the prior art. More specifically, carbon monoxide detectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,896,089; U.S. Pat. No. 5,608,384; U.S. Pat. No. 5,576,739; U.S. Pat. No. 5,379,026; U.S. Pat. No. 5,239,980; and U.S. Pat. No. Des. 350,300.

While these devices fulfill their respective, particular objectives and requirements, the aforementioned patents do not disclose a new carbon monoxide detector. The inventive device includes a carbon monoxide detector that has a housing. The housing is coupled to an exterior surface of a furnace supply duct of a furnace. The carbon monoxide detector also has a probe assembly that extends outward from the housing into the furnace supply duct for detecting a level of carbon monoxide in the furnace supply duct. The carbon monoxide detector further has a control unit. The control unit is operationally coupled with a limiting switch of the furnace. The control unit provides a signal to the limiting switch upon detection of a carbon monoxide level above a pre-determined level whereby the limiting switch is activated to shut off the furnace.

In these respects, the carbon monoxide detector according to the present invention substantially departs from the conventional concepts and designs of the prior art, and in so doing provides an apparatus primarily developed for the purpose of detecting the level of carbon monoxide in a furnace supply duct.

SUMMARY OF THE INVENTION

In view of the foregoing disadvantages inherent in the known types of carbon monoxide detectors now present in the prior art, the present invention provides a new carbon monoxide detector construction wherein the same can be utilized for detecting the level of carbon monoxide in a furnace supply duct.

The general purpose of the present invention, which will be described subsequently in greater detail, is to provide a new carbon monoxide detector apparatus and method which has many of the advantages of the carbon monoxide detectors mentioned heretofore and many novel features that result in a new carbon monoxide detector which is not anticipated, rendered obvious, suggested, or even implied by any of the prior art carbon monoxide detectors, either alone or in any combination thereof.

To attain this, the present invention generally comprises a carbon monoxide detector that has a housing. The housing is coupled to an exterior surface of a furnace supply duct of a furnace. The carbon monoxide detector also has a probe assembly that extends outward from the housing into the furnace supply duct for detecting a level of carbon monoxide in the furnace supply duct. The carbon monoxide detector further has a control unit. The control unit is operationally coupled with a limiting switch of the furnace. The control unit provides a signal to the limiting switch upon detection of a carbon monoxide level above a pre-determined level whereby the limiting switch is activated to shut off the furnace.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new carbon monoxide detector apparatus and method which has many of the advantages of the carbon monoxide detectors mentioned heretofore and many novel features that result in a new carbon monoxide detector which is not anticipated, rendered obvious, suggested, or even implied by any of the prior art carbon monoxide detectors, either alone or in any combination thereof.

It is another object of the present invention to provide a new carbon monoxide detector that may be easily and efficiently manufactured and marketed.

It is a further object of the present invention to provide a new carbon monoxide detector that is of a durable and reliable construction.

An even further object of the present invention is to provide a new carbon monoxide detector which is susceptible of a low cost of manufacture with regard to both materials and labor, and which accordingly is then susceptible of low prices of sale to the consuming public, thereby making such carbon monoxide detector economically available to the buying public.

Still yet another object of the present invention is to provide a new carbon monoxide detector which provides in the apparatuses and methods of the prior art some of the advantages thereof, while simultaneously overcoming some of the disadvantages normally associated therewith.

Still another object of the present invention is to provide a new carbon monoxide detector for detecting the level of carbon monoxide in a furnace supply duct.

Yet another object of the present invention is to provide a new carbon monoxide detector which includes a carbon monoxide detector that has a housing. The housing is coupled to an exterior surface of a furnace supply duct of a furnace. The carbon monoxide detector also has a probe assembly that extends outward from the housing into the furnace supply duct for detecting a level of carbon monoxide in the furnace supply duct. The carbon monoxide detector further has a control unit. The control unit is operationally coupled with a limiting switch of the furnace. The control unit provides a signal to the limiting switch upon detection of a carbon monoxide level above a pre-determined level whereby the limiting switch is activated to shut off the furnace.

Still yet another object of the present invention is to provide a new carbon monoxide detector that will deactivate a furnace if carbon monoxide levels above a pre-determined level are detected in the furnace supply duct until a furnace technician is called to repair the furnace.

Even still another object of the present invention is to provide a new carbon monoxide detector that decrease the amount of deaths attributed to carbon monoxide poisoning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
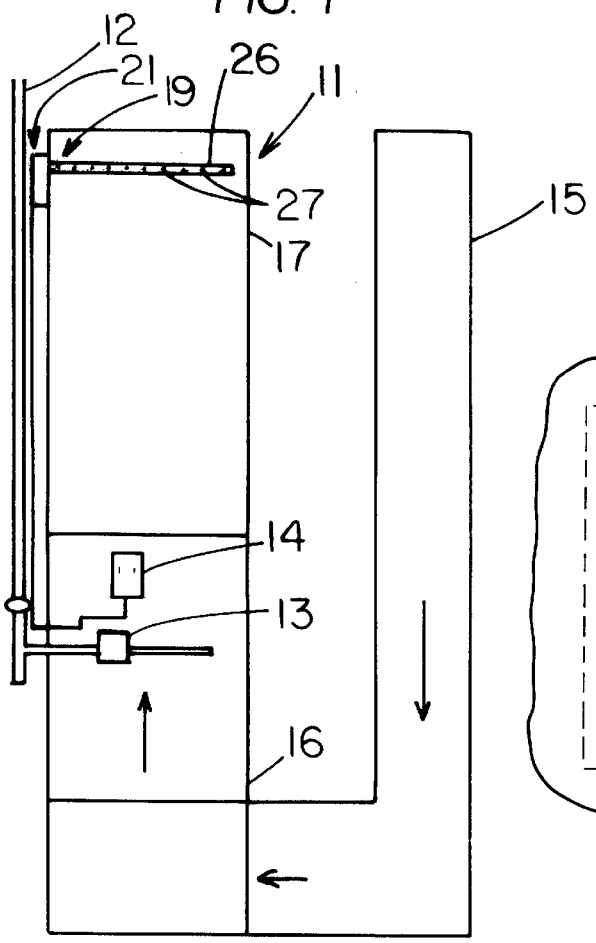
FIG. 1 is a schematic side view of a new carbon monoxide detector coupled to a furnace according to the present invention.
Figure 2:
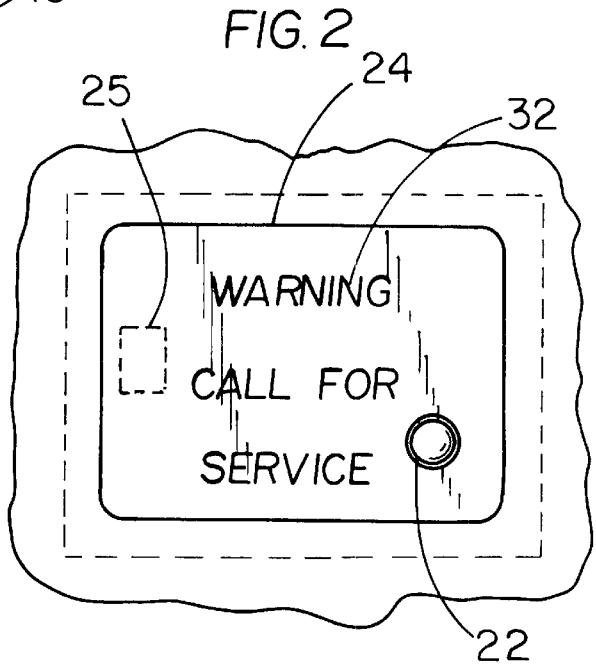
FIG. 2 is a schematic front view of the remote receiving unit of the present invention.
Figure 3:
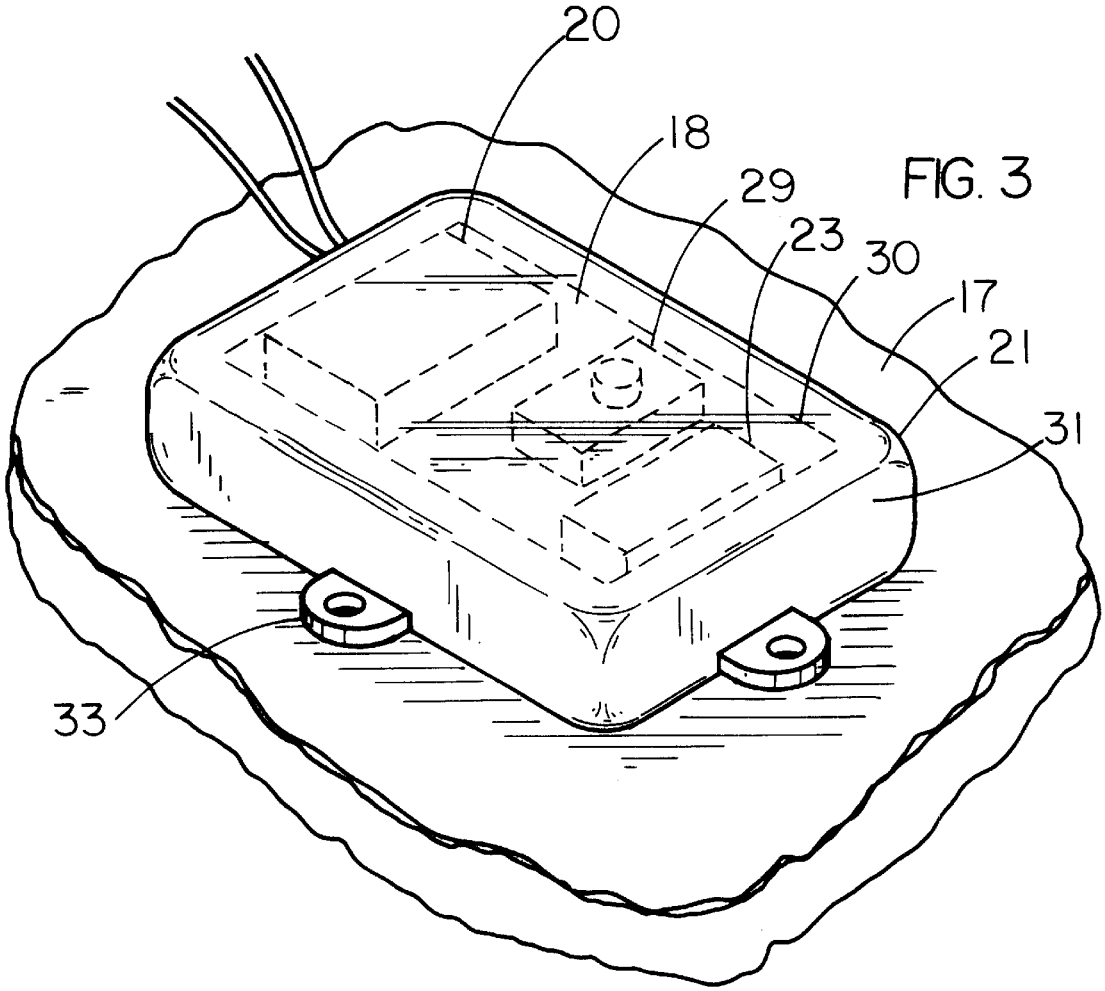
FIG. 3 is a schematic perspective view of the housing of the present invention.
Figure 4:
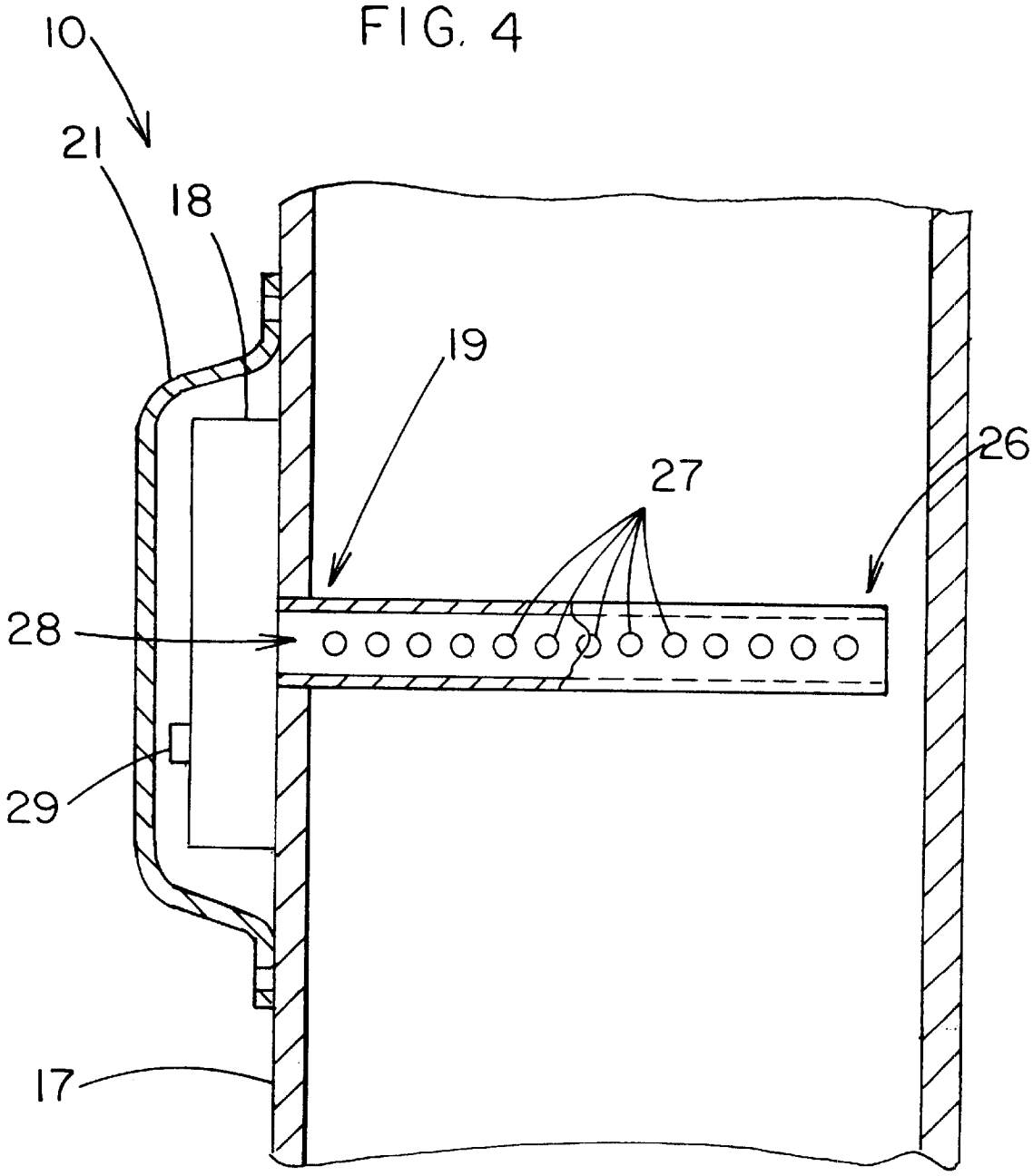
FIG. 4 is a schematic cross-sectional view of the carbon monoxide detector of the present invention, illustrating how it is associated with the furnace supply duct.

With reference now to the drawings, and in particular to FIGS. 1 through 4 thereof, a new carbon monoxide detector embodying the principles and concepts of the present invention and generally designated by the reference numeral 10 will be described.

As best illustrated in FIGS. 1 through 4, the carbon monoxide detector 10 generally comprises a carbon monoxide detector 18, a probe assembly 19 and a control unit 20. The carbon monoxide detector 18 , probe assembly 19 and control unit 20 are coupled to a furnace 11 that has a gas valve coupled 13 to a gas inlet line 12 and a limiting switch 14. The limiting switch 14 is operationally coupled to the gas valve 13 in such a manner that the limiting switch 14 shuts off the gas valve 13 upon detection of a heat level above a pre-determined temperature. When the gas valve 13 is shut off, the furnace 11 is deactivated.

The furnace 11 also has a fresh air return duct 15 that supplies air to a blower compartment 16. A furnace supply duct 17 extends away from the blower compartment 16 of the furnace 11.

The blower compartment 16 provides heated air through the furnace supply duct 17.

The carbon monoxide detector 18 has a housing 21 that is coupled to an exterior surface of the furnace supply duct 17 of the furnace 11. The probe assembly 19 extends outward from the housing 21 through a wall of the furnace supply duct 17 into the furnace supply duct 17. The probe assembly 19 detects the level of carbon monoxide in the furnace supply duct 17.

The carbon monoxide detector 18 has a control unit 20 that is positioned inside the housing 21. The control unit 20 is operationally coupled in series with the limiting switch 14 of the furnace 11. The control unit 20 provides a signal to the limiting switch 14 upon detection of a carbon monoxide level above a pre-determined level. Thus the limiting switch 14 is activated to deactivate the furnace 11.

The probe assembly 19 has an elongated tube 26 that extends into the furnace supply duct 17. The elongated tube 26 has a plurality of holes 27 for collecting air passing by the elongated tube 26 into an interior duct 28 of the elongated tube 26. The control unit 18 is operationally coupled to the probe assembly 19 for measuring an air flow into the interior duct 28 of the elongated tube 26 and a level of carbon monoxide of the air collected into the interior duct 28. The control unit 20 activates the limiting switch 14 upon detection of a level of carbon monoxide over a pre-determined value associated with the measured air flow into the interior duct 28 of the elongated tube 26.

The control unit 20 is designed to provide a continuous signal to the limiting switch 14 upon detection of a level of carbon monoxide over the pre-determined value. Accordingly, the limiting switch 14 is activated continuously while the control unit 20 sends the signal. The carbon monoxide detector 18 also includes a reset control 29 that is operationally coupled to the control unit 20. The reset control 29 discontinues the signal thereby deactivating the limiting switch 14 to permit activation of the furnace 11.

The carbon monoxide detector 18 also includes a transmitter 23 for sending a reset warning signal upon detection of the carbon monoxide level above the pre-determined level. A receiver 25 in a remote receiving unit 24 is designed to receive the reset warning signal from the transmitter 23. When the receiver 25 in the remote receiving unit 24 receives the reset warning signal, a warning light 22 is illuminated to indicate that the carbon monoxide detector 18 has activated the limiting switch 14. The remote receiving unit 24 may be positioned at a remote location relative to the furnace 11 to facilitate its viewing.

The remote receiving unit 24 has indicia 32 positioned on an exterior surface of the remote receiving unit 24. The indicia 32 is positioned proximate the warning light 22. Thus illumination of the warning light 22 draws attention to the indicia 32. The indicia 32 directs a user to call to get the furnace 11 serviced.

The housing 21 has a main wall 30 and a perimeter wall 31 that extends outward from the main wall 30. Thus the housing 21 fully covers the control unit 20 and the reset control 29. The housing 21 prevents a user from manipulating the reset control 29 to circumvent the carbon monoxide detector 1 8 without correcting the cause of the measured carbon monoxide level being above the pre-determined level.

A plurality of connection members 33 extends outward from the housing 21. The connection members facilitate the connection of the housing 21 to the exterior wall of the furnace supply duct 17. The housing 21 may be connected to the furnace supply duct with sheet metal screws.

In use, if the carbon monoxide detector 18 detects a carbon monoxide level above the pre-determined level, the control unit 20 sends a continuous signal to the limiting switch 14. The limiting switch 14 is then activated thereby shutting off the gas valve 13 and deactivating the furnace 11. At the same time, the transmitter 23 of carbon monoxide detector 18 sends a reset warning signal to the receiver 25 of the remote receiving unit 24. The warning light 22 on the receiving unit 24 is then illuminated to inform the user that an unsafe level of carbon monoxide has been detected and the furnace 11 has been deactivated. The user must then call a furnace technician to fix the carbon monoxide problem before the reset control 29 can be accessed and the furnace 11 activated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A carbon monoxide detector system for detecting CO levels in a furnace, said carbon monoxide detector system comprising:

a carbon monoxide detector having a housing adapted for coupling to an exterior surface of a furnace supply duct of a furnace;

said carbon monoxide detector having a probe assembly extending outwardly from said housing, said probe assembly being adapted for extending through a wall of the furnace supply duct for detecting a level of carbon monoxide in the supply duct;

said carbon monoxide detector having a control unit, said control unit being adapted for operationally coupling in series with a limiting switch of the furnace, said control unit providing a signal to the limiting switch upon detection of a carbon monoxide level above a pre-determined level whereby the limiting switch is activated to shut off the furnace;

said control unit providing a continuous signal to the limiting switch whereby the limiting switch is activated continuously while said signal is sent by said control unit;

said carbon monoxide detector including a reset control operationally coupled to said control unit for discontinuing said signal whereby the limiting switch is deactivated to permit use of the furnace; and said housing having a main wall and a perimeter wall extending outwardly from said main wall whereby said housing fully covers said control unit and said reset control for preventing a user from manipulating said reset control to circumvent said carbon monoxide detector without correcting a cause of the carbon monoxide level above said pre-determined level.

2. The carbon monoxide detector system of claim 1, further comprising:

said carbon monoxide detector including a transmitter for sending a reset warning signal upon detection of said carbon monoxide level above said pre-determined level;

a remote receiving unit having a receiver and a warning light, said receiver being operationally coupled to said warning light for illuminating said warning light when said receiver receives said reset warning signal; and said remote receiving unit being for positioning at a remote location relative to the furnace for facilitating viewing of a visual indication that said carbon monoxide detector has activated said limiting switch.

3. The carbon monoxide detector system of claim 1, further comprising:

said probe assembly having an elongated tube extending into the furnace supply duct, said elongated tube having a plurality of holes for collecting air passing by said elongated tube into an interior duct of said elongated tube; and said control unit being operationally coupled to said probe assembly for measuring an air flow into said interior duct of said elongated tube and a level of carbon monoxide of the air collected into said interior duct of said elongated tube, said control unit being adapted for operationally coupling to the limiting switch of the furnace for activating the limiting switch upon detection of a level of carbon monoxide over a pre-determined value associated with said measured air flow into said interior duct of said elongated tube.

4. The carbon monoxide detector assembly of claim 2, further comprising:

said remote receiving unit having indicia positioned on an exterior surface of said remote receiving unit, said indicia being positioned proximate said warning light whereby illumination of said warning light draws attention to said indicia; and wherein said indicia directs a user to call for service for the furnace.

5. The carbon monoxide detector assembly of claim 1, further comprising:

a plurality of connection members extending outwardly from said housing for facilitating connection of said housing to the exterior wall of the furnace supply duct.

6. A carbon monoxide detector system for detecting CO levels in a furnace, said carbon monoxide detector system comprising:

a carbon monoxide detector having a housing adapted for coupling to an exterior surface of a furnace supply duct of a furnace;

said carbon monoxide detector having a probe assembly extending outwardly from said housing, said probe assembly being adapted for extending through a wall of the furnace supply duct for detecting a level of carbon monoxide in the supply duct;

said carbon monoxide detector having a control unit, said control unit being adapted for operationally coupling in series with a limiting switch of the furnace, said control unit providing a signal to the limiting switch upon detection of a carbon monoxide level above a pre-determined level whereby the limiting switch is activated to shut off the furnace;

said carbon monoxide detector including a transmitter for sending a reset warning signal upon detection of said carbon monoxide level above said pre-determined level;

a remote receiving unit having a receiver and a warning light, said receiver being operationally coupled to said warning light for illuminating said warning light when said receiver receives said reset warning signal;

said remote receiving unit being for positioning at a remote location relative to the furnace for facilitating viewing of a visual indication that said carbon monoxide detector has activated said limiting switch;

said probe assembly having an elongated tube extending into the furnace supply duct, said elongated tube having a plurality of holes for collecting air passing by said elongated tube into an interior duct of said elongated tube;

said control unit being operationally coupled to said probe assembly for measuring an air flow into said interior duct of said elongated tube and a level of carbon monoxide of the air collected into said interior duct of said elongated tube, said control unit being adapted for operationally coupling to the limiting switch of the furnace for activating the limiting switch upon detection of a level of carbon monoxide over a pre-determined value associated with said measured air flow into said interior duct of said elongated tube;

said control unit providing a continuous signal to the limiting switch whereby the limiting switch is activated continuously while said signal is sent by said control unit;

said carbon monoxide detector including a reset control operationally coupled to said control unit for discontinuing said signal whereby the limiting switch is deactivated to permit use of the furnace;

said housing having a main wall and a perimeter wall extending outwardly from said main wall whereby said housing fully covers said control unit and said reset control for preventing a user from manipulating said reset control to circumvent said carbon monoxide detector without correcting a cause of the carbon monoxide level above said pre-determined level;

said remote receiving unit having indicia positioned on an exterior surface of said remote receiving unit, said indicia being positioned proximate said warning light whereby illumination of said warning light draws attention to said indicia;

wherein said indicia directs a user to call for service for the furnace; and a plurality of connection members extending outwardly from said housing for facilitating connection of said housing to the exterior wall of the furnace supply duct.

7. A carbon monoxide detector system comprising:

a furnace having a gas valve and a limiting switch, said limiting switch being operationally coupled to said gas valve for shutting off said gas valve upon detection of a heat level above a pre-determined heat level whereby said furnace is deactivated;

said furnace having a furnace supply duct extending away from a blower compartment of said furnace for providing heated air through said furnace supply duct;

a carbon monoxide detector having a housing for coupling to an exterior surface of said furnace supply duct of said furnace;

said carbon monoxide detector having a probe assembly extending outwardly from said housing, said probe assembly extending through a wall of the furnace supply duct into said furnace supply duct for detecting a level of carbon monoxide in the furnace supply duct;

said carbon monoxide detector having a control unit, said control unit being adapted for operationally coupling in series with said limiting switch of said furnace, said control unit providing a signal to said limiting switch upon detection of a carbon monoxide level above a pre-determined level whereby said limiting switch is activated to deactivate said furnace;

said carbon monoxide detector including a transmitter for sending a reset warning signal upon detection of said carbon monoxide level above said pre-determined level;

a remote receiving unit having a receiver and a warning light, said receiver being operationally coupled to said warning light for illuminating said warning light when said receiver receives said reset warning signal;

said remote receiving unit being for positioning at a remote location relative to said furnace for facilitating viewing of a visual indication that said carbon monoxide detector has activated said limiting switch;

said probe assembly having an elongated tube extending into said furnace supply duct, said elongated tube having a plurality of holes for collecting air passing by said elongated tube into an interior duct of said elongated tube;

said control unit being operationally coupled to said probe assembly for measuring an air flow into said interior duct of said elongated tube and a level of carbon monoxide of the air collected into said interior duct of said elongated tube, said control unit being operationally coupled to said limiting switch of the furnace for activating said limiting switch upon detection of a level of carbon monoxide over a pre-determined value associated with said measured air flow into said interior duct of said elongated tube;

said control unit providing a continuous signal to said limiting switch whereby said limiting switch is activated continuously while said signal is sent by said control unit;

said carbon monoxide detector including a reset control operationally coupled to said control unit for discontinuing said signal whereby said limiting switch is deactivated to permit activation of said furnace;

said housing having a main wall and a perimeter wall extending outwardly from said main wall whereby said housing fully covers said control unit and said reset control for preventing a user from manipulating said reset control to circumvent said carbon monoxide detector without correcting a cause of said measured carbon monoxide level being above said predetermined level;

said remote receiving unit having indicia positioned on an exterior surface of said remote receiving unit, said indicia being positioned proximate said warning light whereby illumination of said warning light draws attention to said indicia;

wherein said indicia directs a user to call for service for said furnace; and a plurality of connection members extending outwardly from said housing for facilitating connection of said housing to the exterior wall of the furnace supply duct.

* * * * *